US007768187B2

(12) United States Patent
Kanareikin et al.

(10) Patent No.: US 7,768,187 B2
(45) Date of Patent: Aug. 3, 2010

(54) CHARGE PARTICLE BEAM ACCELERATOR

(76) Inventors: Alexei Dmitrievich Kanareikin, ul. Odesskaya, d.2, kv.4, Saint-Petersburg (RU) 193015; Elizaveta Arkadievna Nenasheva, ul.Esenina, d.20, korp.2, kv.88, Saint-Petersburg (RU) 194356

( * ) Notice: Subject to any disclaimer, the term of this patent is extended or adjusted under 35 U.S.C. 154(b) by 1094 days.

(21) Appl. No.: 10/547,941

(22) PCT Filed: Mar. 2, 2004

(86) PCT No.: PCT/RU2004/000085

§ 371 (c)(1),
(2), (4) Date: Jun. 5, 2006

(87) PCT Pub. No.: WO2004/080131

PCT Pub. Date: Sep. 16, 2004

(65) Prior Publication Data

US 2006/0237661 A1 Oct. 26, 2006

(30) Foreign Application Priority Data

Mar. 5, 2003 (RU) ..... 2003107001

(51) Int. Cl.
*F03H 1/00* (2006.01)

(52) U.S. Cl. ..... 313/359.1; 313/386; 315/506; 250/396 R

(58) Field of Classification Search ..... 315/500, 315/506; 250/396 R, 427; 313/360.1, 386, 313/359.1
See application file for complete search history.

(56) References Cited

U.S. PATENT DOCUMENTS 3,234,426 A * 2/1966 Heil ..... 315/3.6
3,823,335 A * 7/1974 Scheffels et al. ..... 315/15
4,004,175 A * 1/1977 Brody ..... 313/360.1

FOREIGN PATENT DOCUMENTS

EP 428853 A2 * 5/1990
RU 2178243 C2 * 1/2002

* cited by examiner

*Primary Examiner*—Haissa Philogene
(74) *Attorney, Agent, or Firm*—John D. Gugliotta, PE, Esq

(57) ABSTRACT

The invention relates to charged particle beam accelerators, in particular electron beam accelerators, and can be used for physics, chemistry and medicine. The inventive charged particle beam accelerator comprises a metallic shell fitted with a dielectric material layer arranged therein, and a vacuum channel for electron transit embodied along the central symmetry axis of said metallic shell. In addition, the metallic shell is fitted with a ferroelectric material layer arranged therein. Said ferroelectric material layer can be arranged between the metallic shell and the dielectric material layer or in said dielectric material layer. The invention provides an object with a very important property, i.e. said property makes it possible to control the accelerator parameters and regulate the phase balance of the charged particle beam and the wave that accelerates the particles.

10 Claims, 1 Drawing Sheet

CHARGE PARTICLE BEAM ACCELERATOR

TECHNICAL FIELD

The invention relates to charged particle beam accelerators, in particular electron beam accelerators, and can be used for physics, chemistry and medicine.

BACKGROUND ART

Known charged particle beam accelerator comprises a metallic shell fitted with a dielectric material layer arranged therein, and wherein said dielectric material layer is embodied in the form of a bar. In addition, said charged particle beam accelerator comprises vacuum channels for charged particle transit embodied between the metallic shell and the dielectric material and along the central symmetry axis inside the dielectric material (see Rhon Keining et al. "ANNULAR BEAM DRIVEN HIGH GRADIENT ACCELERATORS", proceedings of the $7^{th}$ International Conference "High-Power Particle Beams", 1988, pp. 864-869").

A disadvantage of said accelerator consists in the fact that the bunch of charged particles is unstable and precipitates on the shell walls after a short transit.

Another known charged particle beam accelerator comprises a metallic shell fitted with a dielectric material layer arranged therein, and a vacuum channel embodied along the central symmetry axis of said metallic shell (see W. Gai et al. "Experimental Demonstration of Wake-Field Effects in Dielectric Structures", PHYSICAL REVIEW LETTERS, vol. 61, N. 24, pp. 2756-2758, Dec. 12, 1988).

This engineering solution is taken as a prototype for the present invention.

A disadvantage of said engineering solution consists in the fact that the accelerator parameters cannot be controlled, and the lack of phase balance of the charged particle beam and the accelerating wave lowers the acceleration efficiency.

SUMMARY OF THE INVENTION

The aim of said invention is to enable the accelerator parameters control and, therefore, the phase balance regulation.

According to the invention, the inventive charged particle beam accelerator comprises a metallic shell fitted with a dielectric material layer arranged therein, and a vacuum channel for electron transit embodied along the central symmetry axis of said metallic shell, the metallic shell having an additional ferroelectric material layer arranged therein, and wherein the ferroelectric material layer can be arranged either between said metallic shell and the dielectric material layer or in said dielectric material layer.

The applicant hasn't found any sources of information containing data on engineering solutions identical to the present invention. In applicant's opinion, that enables to conclude that the invention conforms to the criterion "Novelty" (N).

The novel features of the present invention provide an object with a very important property, i.e. said property makes it possible to regulate the phase balance of the charged particle beam and the wave that accelerates the particles. The applicant hasn't found any sources of information containing data on charged particle beam accelerators comprising additional ferroelectric material layer and thereby providing the control of the accelerator parameters.

In applicant's opinion, that enables to conclude that the invention conforms to the criterion "Inventive Step" (IS).

BRIEF DESCRIPTION OF THE DRAWINGS

Hereinafter the invention is illustrated by detailed description of its embodiment with references to drawings as follows.

PREFERRED EMBODIMENT

Figure 1:
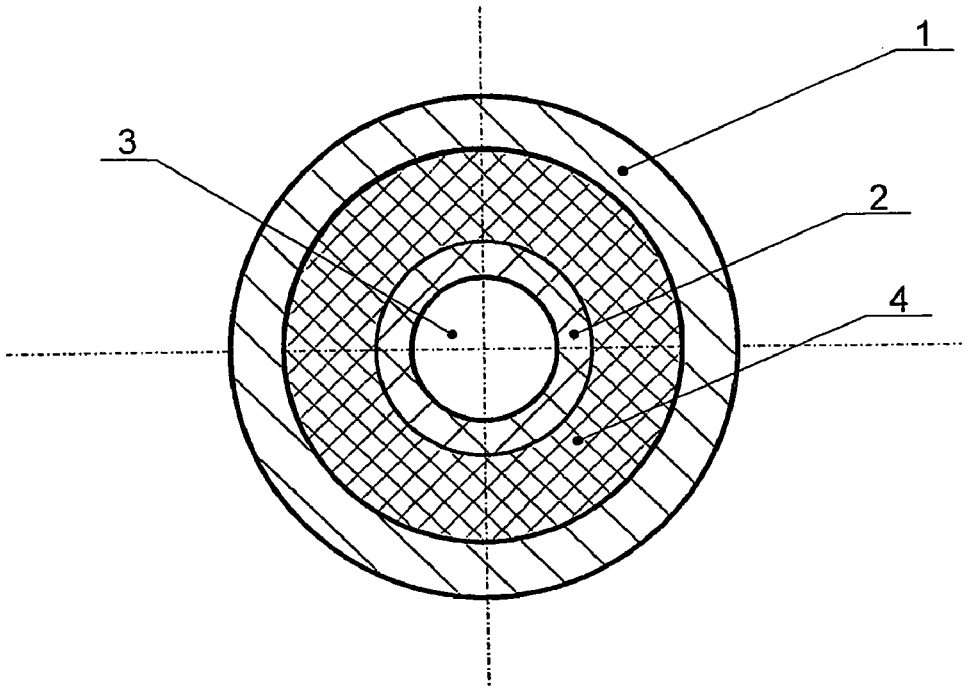
FIG. 1 is a section of the accelerator, wherein the ferroelectric material layer is arranged between the metallic shell and the dielectric.

The charged particle beam accelerator comprises a metallic shell 1 fitted with a dielectric material layer 2 arranged therein and a vacuum channel 3 embodied along the central symmetry axis of said metallic shell 1. The dielectric material is any suitable high-frequency ceramic material with dielectric capacity ($\in$) between 4 and 45. The base of these dielectrics are the oxide systems—compounds and solid solutions, such as cordierite ($2MgO.2Al_2O_3.5SiO_2$) having $\in \approx 4.7$, corundum ($Al_2O_3$) having $\in \approx 9.7$, magnesium and calcium titanates of the MgO—CaO—$TiO_2$ system having $\in$ between 14 and 20, as well as solid solutions of calcium titanate—rare-earth elements' aluminates $CaTiO_3$—$LnAlO_3$ (Ln—La, Nd) having $\in$ between 38 and 45. The distinguishing feature of said class of dielectric materials is their considerably low dielectric loss in the microwave range.

Figure 2:
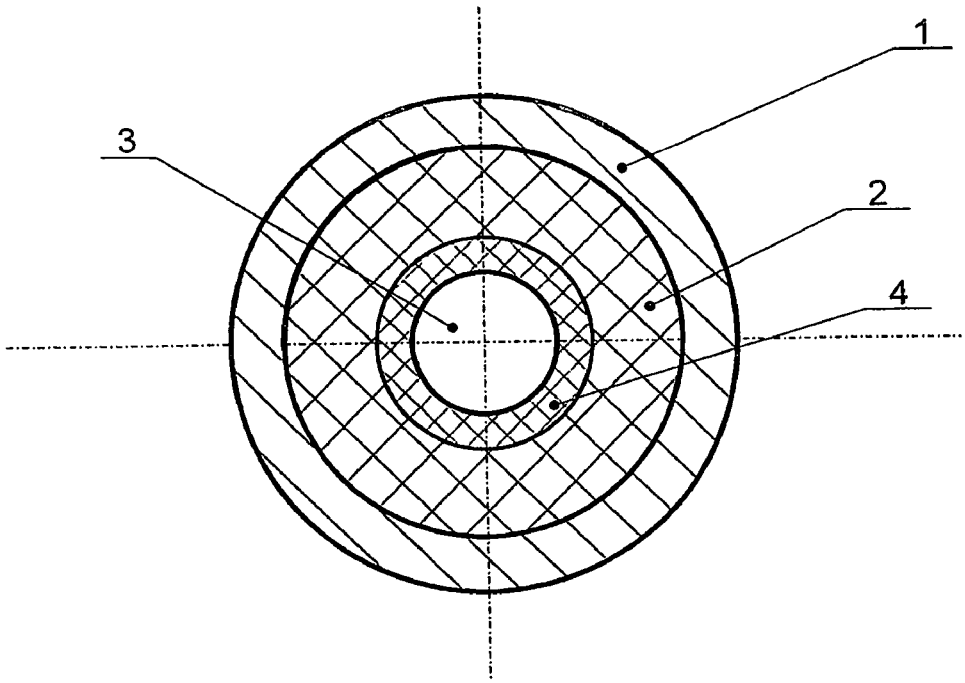
FIG. 2 is a section of the accelerator, wherein the ferroelectric material layer is arranged in the dielectric material layer.

The metallic shell 1 is fitted with an additional ferroelectric material layer 4. Said ferroelectric material layer can be arranged either between the metallic shell 1 and the dielectric material layer 2 (as seen in FIG. 1) or in said dielectric material layer 2 (as seen in FIG. 2). In the particular embodiment of the invention the ferroelectric material is a solid solution of barium and strontium titanates $(Ba,Sr)Tio_3$ with additives of oxides and compounds of various elements. The dielectric conductivity ($\in$) is between 200 and 600, and the dielectric dissipation (tg $\delta$) in the range of 10 . . . 35 GHz is between 0.004 and 0.006; meanwhile the controllability of the electric field acceleration structure is between 5 and 15%. If the parameters of the high-frequency ceramic material and the ferroelectric material correspond to the values mentioned above, the controllability of the acceleration structure will amount to (2-10)% $\Delta\omega/\omega$ (where $\Delta\omega/\omega$ is fractional frequency offset) depending on the thickness of the control ferroelectric material layer and the value of the dielectric capacity.

The device operates as follows.

A high-current beam of low-energy charged particles is supplied to the accelerator by means of an injector of a known type, in the particular embodiment, the beam consists of electrons having energy between 15 and 50 MeV, impulse duration between 10 and 40 nanoseconds and charge between 10 and 100 nanoampere-seconds. Said beam excites in the accelerator a high-frequency electromagnetic wave with frequency between 10 and 35 GHz. Then a low-current beam of high-energy electrons is supplied to the accelerator, the electrons having energy more than 100 MeV, impulse duration between 10 and 40 nanoseconds and charge less than 0.1 nanoampere-seconds. The electrons of the low-current beam are accelerated in the field of the high-frequency electromagnetic wave and then excite high-current electron beams. The phase balance of the low-current electron beam and the high-frequency electromagnetic wave is maintained by generating a constant electric field in the ferroelectric material layer 4; in the particular embodiment this is accomplished by supplying constant electric voltage to the layer 4 through metal contacts arranged therein (not shown). The intensity of the constant electric field is between 1 and 10 V/μm. By changing the value of this parameter you can vary the dielectric capacity of the ferroelectric material, thus adjusting the frequency and, therefore, the phase velocity of the electromagnetic wave relative to the electron beam velocity.

INDUSTRIAL APPLICABILITY

Known constructive materials and common equipment are used for the production of the device, which enables to conclude that the invention conforms to the criterion "Industrial Applicability" (IA).

The invention claimed is:

1. A charged particle beam accelerator comprising a metallic shell fitted with a dielectric material layer arranged therein, and a vacuum channel for electron transit embodied along the central symmetry axis of said metallic shell, and wherein said metallic shell is additionally fitted with a ferroelectric material layer arranged therein.

2. A charged particle beam accelerator in accordance with claim 1 wherein the ferroelectric material layer is arranged between the metallic shell and the dielectric material layer.

3. A charged particle beam accelerator in accordance with claim 1 wherein the ferroelectric material layer is arranged in the dielectric material layer.

4. A charged particle beam accelerator comprising:

a metallic shell having a central axis about which said shell is symmetric;

a dielectric material layer arranged and fitted within said metallic shell;

a ferroelectric material layer between said metallic shell and said dielectric material layer; and a vacuum channel for electron transit embodied along the central symmetry axis of said metallic shell.

5. The charged particle beam accelerator of claim 4, wherein said ferroelectric material layer is a solid solution of barium and strontium titanates (Ba,Sr)Tio3 with additives of oxides and compounds of various elements.

6. The charged particle beam accelerator of claim 4, wherein said ferroelectric material layer has a dielectric conductivity between 200 and 600.

7. The charged particle beam accelerator of claim 4, wherein said ferroelectric material layer has a dielectric dissipation in the range of 10 to 35 GHz of between 0.004 and 0.006.

8. A charged particle beam accelerator comprising:

a metallic shell having a central axis about which said shell is symmetric;

a dielectric material layer arranged and fitted within said metallic shell;

a vacuum channel for electron transit embodied along the central symmetry axis of said metallic shell; and an additional ferroelectric material layer in said dielectric material layer.

9. A charged particle beam accelerator comprising:

a metallic shell having a central axis about which said shell is symmetric;

a dielectric material layer arranged and fitted within said metallic shell, wherein said dielectric material layer is formed of dielectric materials having low dielectric loss in the microwave range; and a vacuum channel for electron transit embodied along the central symmetry axis of said metallic shell.

10. The charged particle beam accelerator of claim 9, wherein said dielectric material layer is formed of dielectric materials selected from systems-compounds and solid solutions.

* * * * *